United States Patent [19]

Fischer et al.

[11] Patent Number: 4,669,273

[45] Date of Patent: Jun. 2, 1987

[54] SELF-COOLING BEVERAGE CONTAINER

[75] Inventors: Victor H. Fischer, Las Vegas, Nev.; Dennis A. Thomas, Woodland Hills, Calif.

[73] Assignee: Liquid $CO_2$ Engineering Inc., Los Angeles, Calif.

[21] Appl. No.: 860,633

[22] Filed: May 7, 1986

[51] Int. Cl.[4] ..... F25D 3/10

[52] U.S. Cl. ..... 62/294; 62/4

[58] Field of Search ..... 62/384, 385, 388, 4, 62/457, 372, 294; 220/67, 89 A

[56] References Cited

U.S. PATENT DOCUMENTS

| | | | |
|---|---|---|---|
| 3,269,141 | 8/1966 | Weiss | 62/294 |
| 3,309,890 | 3/1967 | Barnett et al. | 62/4 X |
| 3,373,581 | 3/1968 | Strader | 62/294 |
| 3,494,141 | 2/1970 | Irwin et al. | 62/294 |
| 3,494,142 | 2/1970 | Beck | 62/294 |
| 3,520,148 | 7/1970 | Fuerle | 62/294 |
| 3,636,726 | 1/1972 | Rosenfeld | 62/294 |
| 3,726,106 | 4/1973 | Jaeger | 62/294 |
| 3,759,060 | 9/1973 | Chase | 62/294 |
| 4,319,464 | 3/1982 | Dodd | 62/294 |
| 4,584,848 | 4/1986 | Barnett | 62/294 |

*Primary Examiner*—Lloyd L. King

*Attorney, Agent, or Firm*—Christie, Parker & Hale

[57] ABSTRACT

A coiled tube insert is provided to cool a beverage within a beverage container by releasing a pressurized liquid refrigerant from the coiled tube to an evaporator to chill the beverage within the container.

4 Claims, 8 Drawing Figures

SELF-COOLING BEVERAGE CONTAINER

BACKGROUND OF THE INVENTION

1. Field of the Invention

The field of the invention is self-contained systems for cooling beverage containers.

2. Description of the Prior Art

Many self-cooling beverage containers have been proposed in the past, but there has been no commercial use of such containers due to their high cost, low refrigeration efficiency, lack of overall simplicity, and in some cases, lack of safety.

These prior containers disclose systems where refrigeration occurs either by gas expanding adiabatically, or where a liquid refrigerant absorbs heat during vaporization. Each of these systems are relatively inefficient and do not generate sufficient refrigeration to rapidly cool a beverage in a container when activated.

The objects of the present invention are to provide a self-cooling insert for a disposable beverage container which will overcome the aforesaid problems by providing an insert which is relatively simple to manufacture, that is thermally efficient so that the beverage contents will be cooled quickly upon opening of the container, and will not pose a danger to people drinking beverages from such containers.

SUMMARY OF THE INVENTION

The aforesaid objects are realized by the present invention which is a self-cooling insert for a beverage container. This insert provides refrigeration system that cools beverage in a container by the triple action of the absorption of heat from the beverage, by the cooling effect of a gas expanding through a nozzle pursuant to the Joule-Thomson effect, and by the cooling effect of the adiabatic expansion of vapors.

The self cooling insert of the present invention comprising a reservoir for containing a pressuried refrigerant, and an evaporator means for containing a gas under pressure. The reservoir is capable of communication with the evaporator means and will communicate therewith upon the activation of a refrigerant release means joining the reservoir and evaporator means.

When the container is opened, the gas pressure within the evaporator means is decreased. This decrease in pressure activates the refrigeration release means which allows refrigerant from the reservoir to be released under pressure into the evaporator means to cool the beverage.

DESCRIPTION OF THE PREFERRED EMBODIMENT

Figure 1:
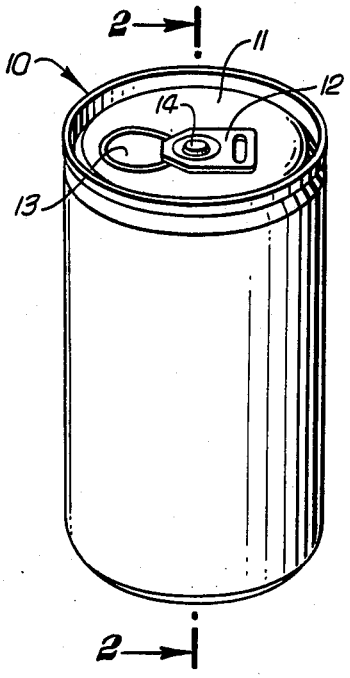
FIG. 1 is a prospective view of the outside of a conventional beverage container having the insert of the present invention contained within.
Figure 2:
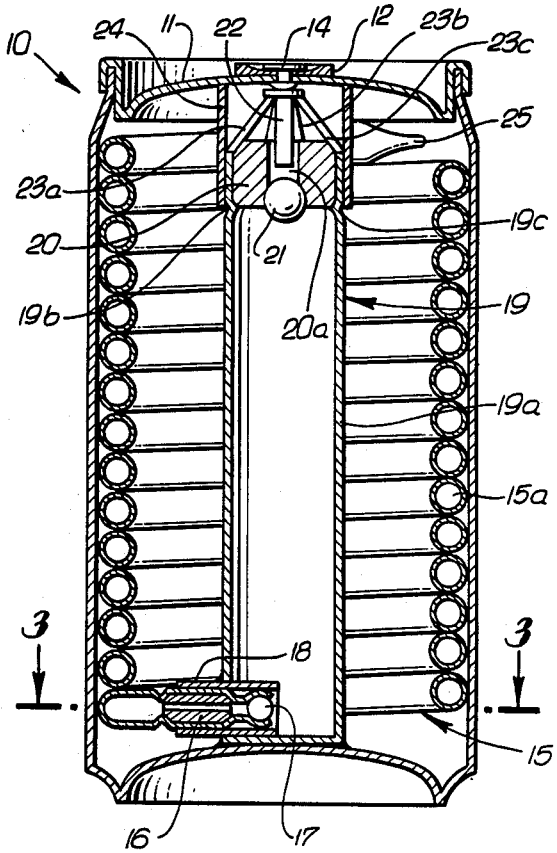
FIG. 2 is a sectional elevational view taken along line 2—2 of FIG. 1 illustrating said insert comprised of a coiled tube assembly and an evaporator housing assembly within the container.

Referring to FIGS. 1 and 2, a conventional disposable beverage container 10 is illustrated having enclosure end wall 11, and opening tab 12 capable of being folded away from end wall 11 to break open a previously weakened aperture portion 13. Tab 12 is fastened to end wall 11 by rivet 14.

Referring to FIG. 2, the self-cooling insert of the present invention comprises a pressurized refrigerant reservoir in the form of a coiled tube assembly 15 containing a pressurized liquid refrigerant, and an evaporator in the form of a cylindrical housing assembly 19. The coiled tube assembly 15 comprises thin walled coiled tube **15*a*, and refrigerant release means in the form of a expansion nozzle 16, expansion check valve ball 17, and evaporator attachment tube 18**.

Figure 3:
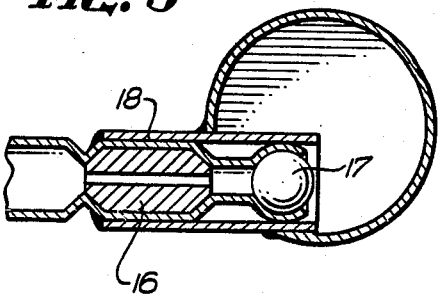
FIG. 3 is an enlarged sectional plan view taken along line 3—3 of FIG. 2 illustrating the base of the evaporator housing having an evaporation attachment assembly projecting therein.

The thin wall coiled tube 15 is manufactured so that its outside diameter will put it in close contact with the inside diameter of container 10 to avoid any movement of the coiled tube within the container. An evaporation attachment tube 18 is welded at the termination of the coil tube **15*a* at the bottom portion thereof. Expansion nozzle 16 is positioned within evaporation attachment tube 18. A check ball 17 is fitted within expansion nozzle 16, as illustrated in FIG. 3. The end of the expansion nozzle 16 is weakly crimped over check ball 17 to maintain the check ball 17 in place, but to allow the ball 17** to be discharged when subject to refrigerant gas pressure.

The cylindrical evaporation housing assembly 19 comprises cylindrical housing **19*a*, valve seat 20, check valve ball 21, plunger 22, plunger supports 23*a, b, c*** and (*d* not shown) and valve seat housing 24.

The evaporator housing **19*a* is a cylindrical tube that is closed at the bottom end and open at its top end. The top end portion of the housing 19 is crimped 19*b*** and *c* to form a shoulder within said housing, and bent inwardly to form the plunger supports **23*a–d*. These plunger supports 23*a–d* are formed by cutting out a portion of the top portion of the housing 19 to form four legs which serve as plunger supports 23*a–d*. Only three of these legs are visible in the sectional view of FIG. 2, namely 24*a, b*** and *c*. These legs are weakened when formed to provide for their easy collapse by the plunger 22 as explained below. A valve seat 20 is positioned in the top portion of the housing **19*a* and is locked into place by resting on the shoulder formed crimps 19*a*** and *b* and by the angular disposition of the plunger supports **23*a–d*. The valve seat 20** is provided with passageway 20*a* to accommodate plunger 22 and to receive check ball 21 at the bottom end thereof.

The check ball 21 is placed in the evaporator housing 19*a* either before the positioning of the valve seat 20 therein, or if the valve seat 20 has been positioned, by introducing the check ball through opening 19*d* in the lower end of the housing 19*a* before the evaporation attachment tube 18 is inserted therein.

The evaporation housing assembly 19 is inserted in the center of the coiled tube 15*a* and the evaporation attachment tube 18 is inserted into opening 19*d* in the bottom portion of the evaporation housing as illustrated in FIG. 2, and welded to the housing 19*a* to fix it in position.

The evaporator housing assembly 19 is pressurized with a compressed gas by inverting the housing assembly 19 having the coiled tube 15 assembly attached thereto. In this inverted position (not shown), check ball 21 will gravitate downwardly and seat itself into valve seat 20. Gas such as carbon dioxide, nitrogen air, or any combination thereof, is then introduced into evaporator housing 19*a* while inverted, through valve seat passageway 20*a*. The introduction of this gas forces the check ball 21 out of the valve seat 20. When the gas within the housing 19*a* reaches a pressure of about 500–1500 psig, the gas is shut off. The pressure of the gas within the housing 19*a* forces the check ball 21 back into the valve seat 20 where it remains and acts as a seal to prevent the escape of pressurized gas out of housing 19*a*. This pressure also causes the check ball 17 in the expansion nozzle 16 to become fully seated and prevents leakage of any refrigerant from the coiled tube 15*a* into housing 19*a*.

After evaporator housing assembly 19*a* is pressurized and the check balls 17 and 21 are seated, the coiled tube 15*a* is partially filled with liquid carbon dioxide, or any other non-toxic liquid refrigerant. After the coils are filled with refrigerant, the coiled tube 15*a* is pinched shut and sealed at its upper end 25.

In the preferred embodiment, the coiled tube 15 is pressurized to maintain the carbon dioxide in a liquid state at about 1,000 psig and at 72° F.

Check valve plunger 22 is put into position, as illustrated in FIG. 2, where it rests on top of the four legs 23*a–d* comprising the plunger supports. The length of the plunger 22 is such that it will not project into check ball 21 when seated on top of said plunger supports 23*a–d*.

The container 10 is then filled with beverage and sealed with enclosure end wall 11. The rivet 14 in the end wall 11 is positioned immediately above the top of plunger 22 and is either touching or nearly touching plunger 22. Enclosure end wall 11 has a circular edge 26 which overlaps the open end of container 10 and is rolled to form a seal over the open top end of the container 10 in a conventional beverage container closure procedure.

Before sealing container 10 with end wall 11, water or a portion of the beverage to be filled in the container 10 is introduced into the void space formed within valve seat housing 24, the plunger supports 23*a–d*, and valve seat passageway 20*a*. The insert is then cooled to freeze the water or beverage within the void space, thereby providing a bearing surface against the end wall 11, and locking the plunger 22 into position and preventing it from prematurely pushing out check ball 21. Thereafter, the coiled tube 15 and evaporator housing 19 assemblies are inserted into a conventional beverage container 10 and filled with beverage.

When the end wall 11 is seated and sealed on the container as aforesaid, it would normally be in a flat position, but for the presence of valve seat housing 24 and frozen liquid therein, both of which are slightly above the plane of the flat end wall 11, causing said end wall 11 to deflect outwardly and become convex due to the resistance offered by the ice within the void space. If the ice were not present, the pressure from seating and sealing the end wall might cause the weakened plunger supports 23*a–d* to collapse, thereby causing the plunger 22, which is immediately underneath the end wall 11, to prematurely eject check ball 21, thereby release pressurized gas within evaporation housing 19*a*.

The presence of the ice in the void space, however, offers resistance to the end wall while it is being seated and sealed and prevents the premature unseating of check ball 21 by plunger 22.

After the beverage container 10 and end wall 11 are sealed, the vapor pressure from the beverage will normally rise within the container to about 50–150 psi. This pressure will maintain the end wall 11 in its deflected condition so that when the ice or beverage melts in the void space, the end wall will not assume its previous flat position.

Thus the container 10 will be left in a condition whereby the top of the plunger 22 is still in close association with the rivet 14 in the end wall 11, so that when tab 12 is opened, it will cause a slight downward deflection of rivet 14 which will be transmitted to plunger 22 and plunger supports 23*a–d*, which collapse and allow plunger 22 to unseat check ball 21 and release pressurized gas from housing 19.

Figure 4:
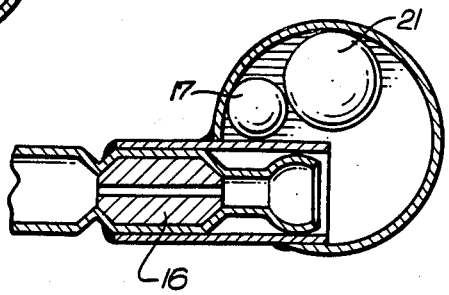
FIG. 4 is an enlarged sectional plan view as shown in FIG. 3, illustrating the base of the evaporator housing and the release of the check valve balls after gas pressure has been released from the evaporator housing.

The lower pressure within evaporator housing 19*a* allows check valve ball 21 to fall to the bottom of the evaporator housing 19*a* and allows the high pressure within coiled tube 15*a* to eject the check valve ball 17 from the expansion nozzle 16 into evaporator housing 19*a*, as shown in FIGS. 3 and 4.

With ball 17 being ejected, liquid carbon dioxide is released from coiled tube 15*a* into the evaporator housing 19*a* through expansion nozzle 16. The length and diameter of nozzle hole 16*a* in expansion nozzle 16 regulates the flow of liquid carbon dioxide into housing 19*a*.

When liquid carbon dioxide refrigerant from coiled tube 15*a* is exposed to the near atmospheric pressure within evaporator housing 19*a*, a portion of said liquid spontaneously vaporizes, thereby lowering the temperature of the released liquid carbon dioxide until the liquid solidifies as dry ice, at about −70° F., on the inside walls of the evaporator housing 19*a* by the Joule Thomson process, thereby cooling the beverage surrounding the outer walls of evaporator housing 19*a*. Heat from the beverage surrounding coiled tube 15*a* is absorbed by liquid carbon dioxide within the coiled tube 15*a* and vaporizes some of the carbon dioxide. This carbon dioxide vapor expands and rises to the top of coiled tube 15*a*, thereby assisting to maintain a high pressure within the tube 15*a* to eject all the liquid carbon dioxide through the expansion nozzle 16 and into evaporator housing 19*a*.

Thus, with the insert of the present invention, cooling of the beverage is accomplished by the triple action of the absorption process in both the pressurized coiled tube 15*a* and the evaporator housing 19*a*, the cooling process of the Joule-Thomson expansion effect through the expansion nozzle 16, and the additional adiabatic expansion of vapors within the evaporator housing 19*a* prior to the vapors being exhausted to the atmosphere.

Figure 5:
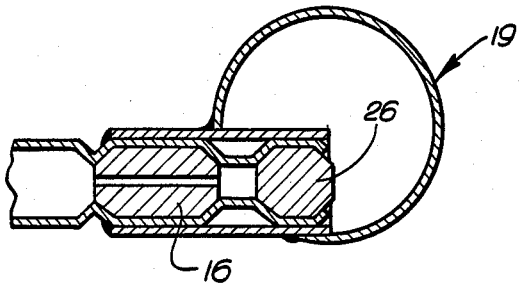
FIG. 5 is an enlarged sectional plan view as shown in FIG. 3, illustrating another embodiment of the present invention utilizing a check valve in the form of a tapered plug.
Figure 6:
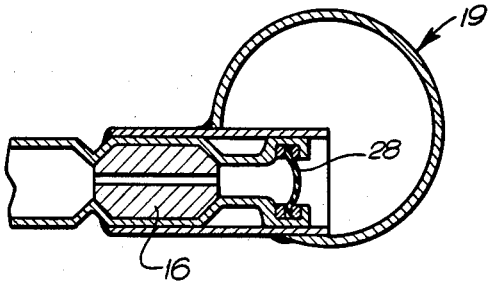
FIG. 6 is an enlarged sectional plan view as shown in FIG. 3, illustrating another embodiment of the present invention utilizing a check valve in the form of a frangible diaphragm.

FIGS. 5 and 6 illustrate other embodiments of the invention wherein check ball 17 in the evaporation attachment tube 18, is replaced with a tapered plug 26 or a frangible diaphragm 28.

Figure 7:
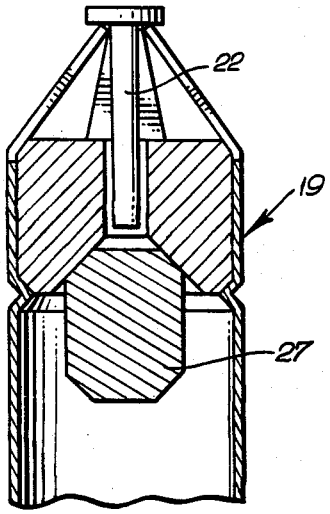
FIG. 7 is an enlarged partial sectional view of the top portion of the evaporator housing illustrating another embodiment of the present invention utilizing a check valve in the form of a tapered plug.
Figure 8:
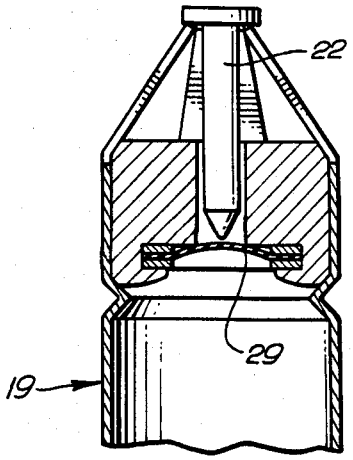
FIG. 8 is an enlarged partial sectional view of the top portion of the evaporation housing illustrating another embodiment of the present invention utilizing a check valve in the form of a frangible diaphragm.

In yet other embodiments of the present invention as illustrated in FIGS. 7 and 8, the check valve ball 21 is replaced with a tapered plug 27 or a frangible diaphragm 29. When the frangible diaphragm 29 is used, the plunger 22 is provided with a sharp point as shown in FIG. 8.

While the embodiment of the invention chosen herein for purposes of disclosure is at present considered to be preferred, it is understood that this invention is intended to cover all changes and modifications in all of the disclosed embodiments which fall within the spirit and scope of the invention.

We claim:

1. A self-cooling insert for insertion into a beverage container for cooling a beverage therein, said container having an end wall for sealing an open end of said container, and a tab rivetted to said end wall for opening an aperture portion in said end wall through which a beverage within the container is dispensed, said insert comprising:

a coiled tube assembly for containing a liquid refrigerant under pressure, and an evaporator housing assembly for containing a gas under pressure, said coiled tube assembly comprising a coiled tube capable of communication with said evaporator housing and joined thereto by evaporation attachment tube having an expansion nozzle and an expansion check ball releasably fixed within said expansion nozzle, said coiled tube communicating with said evaporator housing upon the release of said expansion check ball, said evaporator housing assembly comprising an evaporator housing, a plurality of plunger supports in the upper portion of said evaporator housing, a valve seat within said upper portion, said valve seat having a passageway therein, and a valve seat housing which projects slightly above the plane of end wall 11 when seated onto the open end of said container, an evaporator check valve ball for seating in said valve seat, and a check valve plunger resting on said plunger supports and touching or nearly touching the rivet on the end wall when said end wall is sealed onto said container, said plunger projecting downwardly through said valve seat passageway and in close proximity to said check valve ball when seated in said valve seat.

2. A self-cooling insert as set forth in claim 1 wherein said coiled tube has an outside diameter that will fit against the inside walls of said container, said evaporator housing is vertically disposed at or near the center of said coil, and wherein said valve seat rests on a shoulder provided in the interior of said housing, and is fixed into position by said shoulder and said plunger supports which are folded inwardly to secure said valve seat.

3. A self-cooling insert as set forth in claims 1 or 2 wherein said insert is inserted and sealed into said beverage container by said end wall, said reservoir being charged with liquid refrigerant under pressure, and said evaporator means being charged with gas under pressure.

4. A method of cooling a beverage container having a self-cooling insert as set forth in claims 1 or 2, said method comprising"

charging said coiled tube assembly with a liquid refrigerant under pressure and charging said evaporator housing assembly with a gas under pressure to seat said expansion check ball and said evaporator check ball in their respective expansion nozzle and valve seat, filling with water or beverage, void spaces within the upper portion of said housing above said valve seat, within said valve seat housing, with said plunger supports, and within said valve seat passageway, and feezing said water or beverage, filling said container with beverage and sealing the open end thereof with said end wall, whereby the frozen water or beverage within said void spaces in the upper end portion of said housing will push against said end wall and cause said end wall to assume a convex position, allowing said frozen water or beverage to melt and allowing said beverage to generate a vapor pressure capable of maintaining the convex shape of said end wall, folding over said table to open the aperture portion in said end wall to cause said rivet to push against said plunger and plunger supports, thereby causing the collapse of said plunger support and causing said plunger 22 to push against and unseat check ball 21, thereby causing a decrease in pressure within said evaporator housing which allows said expansion valve check ball to fall to the bottom of said housing to permit the pressure of the refrigerant in the coiled tube to expell said evaporator check ball and allow for the release of refrigerant into said evaporator housing and the cooling of said beverage.

* * * * *